US010643594B2

(12) United States Patent
Krumins et al.

(10) Patent No.: US 10,643,594 B2
(45) Date of Patent: May 5, 2020

(54) EFFECTS DEVICE FOR A MUSICAL INSTRUMENT AND A METHOD FOR PRODUCING THE EFFECTS

(71) Applicant: Gamechanger Audio SIA, Riga (LV)

(72) Inventors: Ilja Krumins, Riga (LV); Martins Melkis, Riga (LV); Kristaps Kalva, Plavinas (LV)

(73) Assignee: Gamechanger Audio SIA, Riga (LV)

( * ) Notice: Subject to any disclaimer, the term of this patent is extended or adjusted under 35 U.S.C. 154(b) by 0 days.

(21) Appl. No.: 16/319,905

(22) PCT Filed: Jul. 30, 2017

(86) PCT No.: PCT/IB2017/054637
§ 371 (c)(1),
(2) Date: Jan. 23, 2019

(87) PCT Pub. No.: WO2018/025147
PCT Pub. Date: Feb. 8, 2018

(65) Prior Publication Data

US 2019/0266986 A1 Aug. 29, 2019

Related U.S. Application Data

(60) Provisional application No. 62/369,134, filed on Jul. 31, 2016.

(51) Int. Cl.
*G10H 1/00* (2006.01)
*G10H 1/02* (2006.01)
(Continued)

(52) U.S. Cl.
CPC ..... *G10H 1/125* (2013.01); *G10H 1/0033* (2013.01); *G10H 1/02* (2013.01);
(Continued)

(58) Field of Classification Search
CPC ..... G10H 2210/125; G10H 2240/325; G10H 2240/175; G10H 2210/066; G10H 1/20;
(Continued)

(56) References Cited

U.S. PATENT DOCUMENTS 6,140,568 A * 10/2000 Kohler ..... G10H 1/0066 84/616
6,392,135 B1 * 5/2002 Kitayama ..... G10H 1/0575 84/622

(Continued)

OTHER PUBLICATIONS

Anonymous, Freeze Sound Retainer, Published online at www.ehx.com/products/freeze, as of Jan. 27, 2012 retrieved from https://web.archive.org/web/20120127112625/www.ehx.com/products/freeze on Jan. 23, 2018.

*Primary Examiner* — Marlon T Fletcher
(74) *Attorney, Agent, or Firm* — Smaprtpat PLC

(57) ABSTRACT

An effects device for a musical instrument, comprising: an input (18) for receiving a signal from a musical instrument; a control input (7) for receiving a control signal; an output (8, 9) for connecting the device to a sound reproduction device; a memory (30) configured to record the input signal; and a processor (29) configured, upon receiving a control signal, to select a section of the recorded input signal from the memory (30) and to loop it, wherein the processor (29) is configured to overlap a start and end regions of the selected section when looping. A method is also provided for producing an effect for a musical instrument, comprising the steps: a) recording an input signal from a musical instrument into memory (30), b) selecting a section of the recorded input signal and looping it, wherein a start and end regions of the selected segment are overlapping when looping.

19 Claims, 16 Drawing Sheets

(51) Int. Cl.
*G10H 1/18* (2006.01)
*G10H 1/12* (2006.01)

(52) U.S. Cl.
CPC . *G10H 2250/101* (2013.01); *G10H 2250/631* (2013.01); *G10H 2250/645* (2013.01)

(58) Field of Classification Search
CPC ..... G10H 2250/035; G10H 2210/155; G10H 2240/141; G10H 2210/005; G10H 2210/241; G10H 2210/295
See application file for complete search history.

(56) References Cited

U.S. PATENT DOCUMENTS

| | | | | |
|---|---|---|---|---|
| 2008/0295672 | A1* | 12/2008 | Compton ..... | G09B 15/009 84/605 |
| 2009/0019996 | A1* | 1/2009 | Fujishima ..... | G10H 1/0025 84/625 |
| 2015/0013528 | A1 | 1/2015 | Buskies et al. | |

* cited by examiner

| | OUT1 plugged in | OUT1 and OUT2 plugged in |
|---|---|---|
| SPLIT ON | OUT1: Dry & wet mix | OUT1: Wet signal only |
| | OUT2: No signal | OUT2: Dry signal only |
| SPLIT OFF | OUT1: Dry & wet mix | OUT1: Dry & wet mix |
| | OUT2: No signal | OUT2: Dry signal only |

EFFECTS DEVICE FOR A MUSICAL INSTRUMENT AND A METHOD FOR PRODUCING THE EFFECTS

TECHNICAL FIELD

This invention relates to the field of musical instrument technology and in particular to electronic effects devices.

BACKGROUND

Currently, nearly all musicians who play live or record music incorporate electronic effects units in their performance in some way. Such electronic effects units can be used to enhance the sound possibilities of any instrument type, including acoustic and electric string instruments, wind instruments, percussion instruments and vocals. The most common users of such effects units are guitarists (electric guitar in particular) and there is a large variety of electronic effects devices available for guitars.

In most cases, effects units for guitar are designed as separately powered devices, activated by foot-operated switches or pedals, and are placed in the signal path between the instrument and the amplification or recording equipment.

Most stringed and fretted instruments, including the electric and acoustic guitar have a certain set of limitations, due to the physical nature of the strings, and how notes are formed.

First of all, a plucked or bowed string can only produce one fundamental note at a time and the note's tonality is determined by where the string is pressed on the fret-board. Therefore—a six-string guitar allows only six notes to be played at once. For comparison—wind instruments such as saxophone, trumpet, etc., usually produce only one tone at a time whereas a grand piano can produce 88 notes simultaneously if all keys are struck at once.

Secondly, the natural decay-length of the sound produced by the strings (chords or individual notes) is pre-determined by the physical characteristics of each particular instrument type, string gauge, playing volume, resonator size etc. Sounds produced by strings (both fretted and unfretted) can also get muted easily, as soon as they are touched while a note is ringing. Also, any fretted note requires constant physical contact between the string and the fret-board in order to keep ringing—as soon as the contact is interrupted, when the string is released from the fret-board, the note ceases to ring (sound dies).

Acoustic pianos typically offer a built-in Sostenuto pedal, which can be used to significantly extend the decay length of all notes played and achieve long ringing notes and chords with only a short tap of the keys. This function is made possible with the use of built-in string dampers, which are mechanically lifted away from the piano's strings when the Sostenuto pedal is pressed, thus letting notes ring out in their full length, even after the keys are released.

Thus pianists can play rhythm and harmony parts with their left hand, while playing melodies on top with the right hand, while guitarists are usually limited to playing only one musical part at a time. In some cases it is possible to compose such song arrangements which combine chords and melody; however this requires mastering a highly complex playing technique that also leaves little space for improvisation. In most cases, guitarists are forced to constantly switch between playing chords and solo/melodic parts. In situations where the guitar is the only harmonic instrument (in small bands or when playing unaccompanied) this can be a real limiting factor.

In response to these limitations—a separate class of digital and electronic effects units have been introduced to give guitarists, as well as other musicians, the ability to layer the signal produced by the instrument—play multiple musical parts at once—and in some cases to accompany themselves.

The following section discusses the most commonly used devices and their characteristics, i.e. existing solutions and their shortcomings.

Delay units: Delay effects units are used to expand the instrument's sound, by adding a repeating, decaying echo to the signal output. The instrument's input signal is being constantly recorded onto an audio storage medium, and then played back rhythmically at a certain tempo set by the musician; the number of playback times and the decay in the playback volume are also variable.

Delay effects units are some of the most commonly-used effects for guitars, vocals and other instruments, however they are not useful for separating harmonic/rhythm parts from melodies/solos, since they affect both signals and produce very distinct continuous rhythmical patterns.

Looping systems: Looping units are usually foot-controlled devices that allow musicians to perform multi-track recording in real-time and play different tracks in a continuous loop. For example, by recording a rhythmic chord and harmony part on a separate track and playing it back instantly, one can proceed playing a new musical part on top—that way creating multiple layers of sounds and performing more detailed musical arrangements. This system however requires sequential input of audio data, and also it limits the musical performance to a specific predetermined loop-length, set by the user—for example—4 bars or 8 bars etc.

Synthesizer units: Certain synthesizer units are able to mimic analog instruments in real-time create and continuous tones, based on the tonality of notes/chords being played. In some devices upon receiving a control signal, the pitch and timbre of the note/chord that is being played at that particular moment is measured and the device uses oscillators and envelope filters to reproduce an approximation of that sound.

Such effects units are versatile and can be played dynamically, but in most cases they sound different from real instruments, since the output is generated with oscillators and not actual audio samples.

The purpose of the invention is to create an electronic effects unit that is able to "stretch out" any complex audio signal (chords, intervals etc.) thus offering musicians, primarily guitarists, an alternative way of playing multiple musical parts simultaneously, extending the length of notes—a principle similar to the Sostenuto pedal found on most acoustic pianos.

SUMMARY

This Sostenuto-style effect is achieved by means of digital signal processing, using a method that the developers have named adaptive real-time sampling and looping.

The purpose of the invention is achieved by an effects device for a musical instrument, comprising: an input for receiving a signal from a musical instrument; a control input for receiving a control signal; an output for connecting the device to a sound reproduction device; a memory configured to record the input signal; and a processor configured, upon receiving a control signal, to select a section of the recorded input signal from the memory and to loop it, wherein the processor is configured to overlap a start and end regions of the selected section when looping.

Preferably, the processor is further configured to choose the overlapping start and end regions based on the regions similarity. The regions similarity may be determined, for example, by calculating correlation between the regions.

Advantageously, the processor is configured to cross-fade the overlapping start and end regions of the selected section when looping.

It is advisable to choose from the memory the section containing the longest possible portion of the recorded input signal suitable for looping. Preferably, the processor is configured to determine and select the longest signal portion where variance of signal is the steadiest.

The processor may be further configured to filter the selected section of the recorded input signal. Preferably, the filtering of the selected section is done by applying an adaptive parametric equalizer which normalizes the harmonic content between loop end-points so that the produced sound is even.

The processor may be further configured to dynamically compress the selected section so that the whole section sounds even.

The device may be further provided with an additional control input that allows modifying the decay length of the looped signal.

Preferably, the processor is further configured to filter the looped signal so that higher harmonics decay faster than lower harmonics while the most significant harmonic is gradually enhanced to resemble a particular guitar's signal.

In a second aspect a purpose of the invention is achieved by a method of producing an effect for a musical instrument, comprising the steps of a) recording an input signal from a musical instrument into memory, and b) selecting a section of the recorded input signal and looping it, wherein a start and end regions of the selected segment are overlapping when looping.

Preferably, the selected section contains the longest possible portion of the input signal showing the steadiest signal variance.

Advantageously, the overlapping start and end regions are selected based on the regions similarity.

Preferably, the overlapping start and end regions of the selected section are cross-faded.

The method may further comprise the step when the selected section is filtering by applying an adaptive parametric equalizer that normalizes the harmonic content of the signal thus ensuring an even sound for the whole section. Additionally, the selected section may be dynamically compressed to ensure that the total section sounds even.

The method may further comprise the step of modifying the length of decay of the looped playback. The method may still further comprise the step of filtering the looped playback so that higher harmonics decays faster than lower harmonics thus the most significant harmonic is gradually enhanced to resample a typical guitar signal.

In the current preferred embodiment of the device—pressing a "stompbox" type foot-pedal shortly after a chord or note is played (most recent musical event), triggers the device's MCU to start producing a prolonged, even continuation of that particular musical event—for as long as desirable for the musician.

The device is able to generate wet signal using small audio samples recorded in real-time, played in a continuous circular loop, and meanwhile the musician is free to add new dry signal to the mix by playing on top of the newly-formed loop.

For example—instead of holding a chord for 2 seconds, a musician may hold the chord for 0.4 seconds, and then press the foot-pedal and release his/her hands from the strings. The proposed device may continue to synthesize the remaining 1.6 seconds of a decaying chord using a new unique sample created in real-time from the most recent audio signal stored in its memory (the first 0.4 seconds of the musical event). During these 1.6 seconds the musician may already start playing a new melodic line on top of the sound of a decaying chord, thus creating an effect of two musicians playing simultaneously.

Therefore, unlike commonly used oscillator-based and digital synthesizers, the proposed device is not able to generate new tonal content autonomously, and always requires a previous audio signal (most recent musical event) for sampling and generating new sound (wet signal). In the opinion of the inventors, notes and chords produced using the real-time audio sampling and looping method proposed by this invention offer a much more accurate, realistic tonal and dynamic representation of the character and timbre each particular instrument.

The proposed invention is an electronic sampling and playback device, housed inside a stompbox-type metallic casing with a foot-operated pedal controller, for inputting the control signal. The device contains one ¼ jack signal input for receiving the instrument's signal, two ¼ jacks signal outputs, a 9V DC power supply input, as well as several potentiometers for adjusting the devices variable functions and several indication LEDs.

The device's main electronics may consist of an input pre-amplifier, output amplifier, audio codec, processor and memory configured to record the input signal (for some amount of time) and perform signal processing. The processor is configured, upon receiving the control signal, to select a portion of the most recently recorded signal from the memory and to loop it and apply certain compression and equalization filters, in such a way that a seamless, continuous sound is formed out of the sampled audio portion. The synthesized sound may be further adjusted to mimic the natural characteristics of instruments by applying variable frequency decay filters and a gradual overall volume decrease.

DETAILED DESCRIPTION

Figure 1:
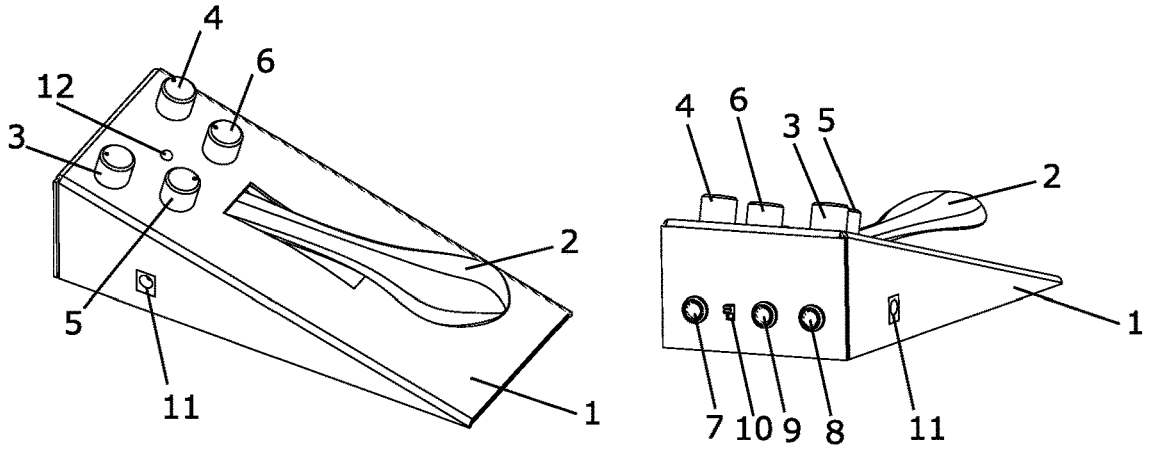
FIG. 1 is an illustration of the device's outer body and external elements.

The following provides clarification of certain recurring terminology used in this document.

Dry signal—analog audio signal coming from a musical instrument (via pick-up systems, microphones, etc.).

Musical event—Any separate chord, note or interval performed on a musical instrument.

Complex audio signal—as opposed to oscillator-generated tones or audio output from single-strings, complex audio signal may consist of multiple main harmonics (polyphony) and an array of overtones, as well as leaking frequencies from microphones or pick-up systems.

Attack—the initial impulse of a musical event,—for example the moment of strumming or plucking of a set of strings, first contact when blowing into a wind instrument's mouthpiece, etc.—usually the loudest part of the musical event, with a percussive nature.

Decay—the main part of the musical event following the attack—for example the gradual decay of a ringing set of strings, sustained wind instrument note, etc.

Release—the abrupt cessation of a musical event, such as lifting fingers away from a guitar's strings—usually considered as noise.

Sample—The isolated decay part of a given musical event, suitable for looping for cross-fading and looping.

Looped sample—Sample, played in a circular loop, forming an even continuous sustained tone.

Wet signal—Looped sample with all necessary post-effects added, such as time-varying EQ, volume fade, Rise and Tail regions, and other. The wet signal is considered the end-product of the current invention/method.

External Parts, Features

The following description relates to the preferred embodiment of the invention (FIG. 1) and aims to describe the optimal configuration of the sound synthesis method for live-performance use. The invention aims to provide the musician with an option of effortlessly sustaining the decay-sound of any complex audio signal, for example—full chords, intervals or individual notes and harmonics—and prolonging their decay length according to needs.

The device in the preferred embodiment is contained within a rigid metallic body 1 (FIG. 1) suitable to withstand heavy-duty conditions and aggressive use of the foot-operated pedal 2 for inputting the control signal 34. The device's main preferred user interface is a spring-loaded foot-operated metallic pedal 2 for inputting the main control signal 34, in the shape of a piano's Sostenuto pedal. The pedal 2 for inputting the control signal 34 connects internally to a two-position on/off contact switch 13 (FIG. 2). Future versions of the device may include a gradual multi-positional or pressure-sensitive switch, which may be used, for example, to interact with one of the device's adjustable parameters, such as the response-speed of the device (fade-in or fade-out speed of the wet signal, upon receiving the main control signal 34)

In the current preferred embodiment, four external rotary potentiometers 3, 4, 5, 6 (FIG. 1) are mounted on the top-facing panel of the device, allowing for easy access to the device's adjustable parameters. It is desirable to give the user maximum control over the majority of the device's features, such as:

- the volume relationship between the dry signal and the wet signal, upon receiving the control signal (BLEND potentiometer 3),
- the wet signal's decay-length (TIME potentiometer 4),
- the dry signal's temporary volume and/or gain increase, upon receiving the control signal (GAIN potentiometer 5).
- the wet signal's resolution/smoothness (GLITCH potentiometer 6), The preferred embodiment also offers two internal potentiometers 15, 16 (FIG. 3), located on the main printed circuit board (PCB, FIG. 2) for adjusting the speed at which the wet signal fades in or out of the overall mix upon receiving the main control signal 34.

Figure 3:
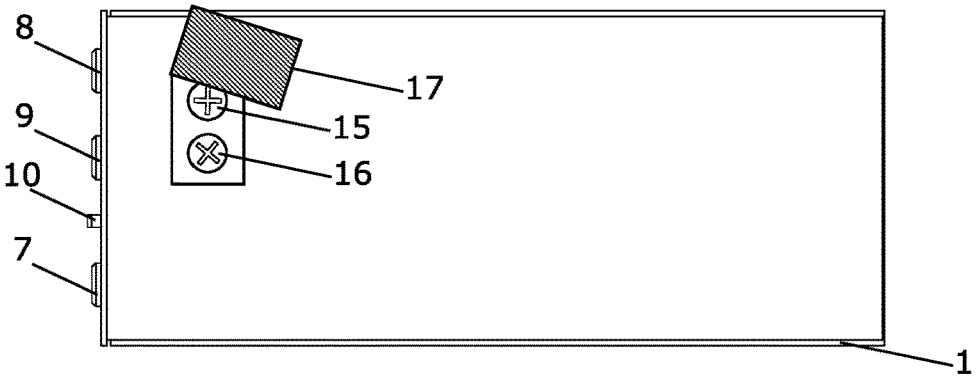
FIG. 3 shows the device's bottom side with internal potentiometers.

Currently the wet signal's fade-in speed (RISE) and fade-out length (TAIL) are determined automatically in relation to the value of the TIME potentiometer 4, but user may extend or shorten the ratio by removing a special protective rubber cover 17 (FIG. 3) and adjusting the internal potentiometers 15, 16 (FIG. 3).

The number of potentiometers offered by the device, their specific names, purposes and configuration may change in future versions of the device.

Figure 2:
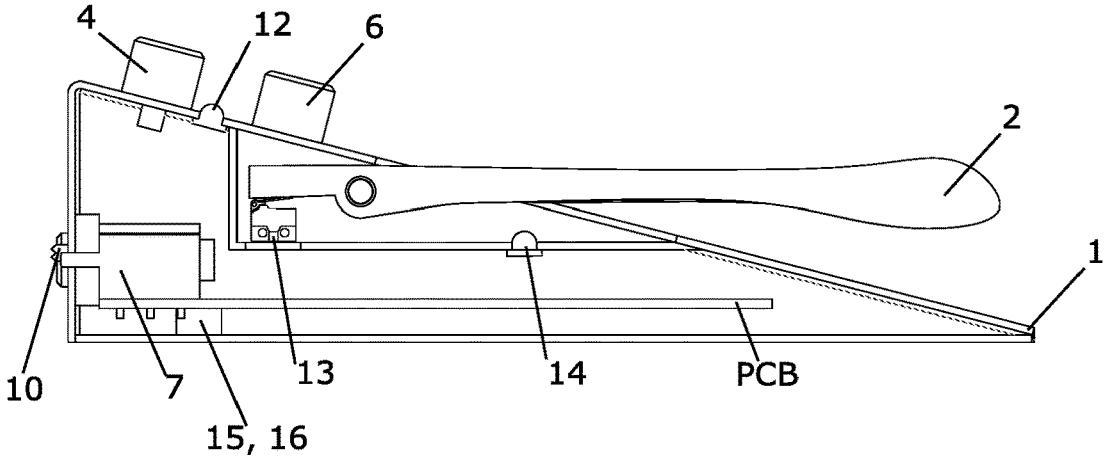
FIG. 2 shows a cross-section of the device.

Dry audio signal from instruments is received by the device via one standard ¼ inch jack input 7 (FIG. 1). The device is designed to work well with any analog audio signal source (magnetic pickups, piezo pickups, microphones, etc.). Other types of inputs may be used in future versions of the device (XLR, RCA etc.).

Figures 5, 6:
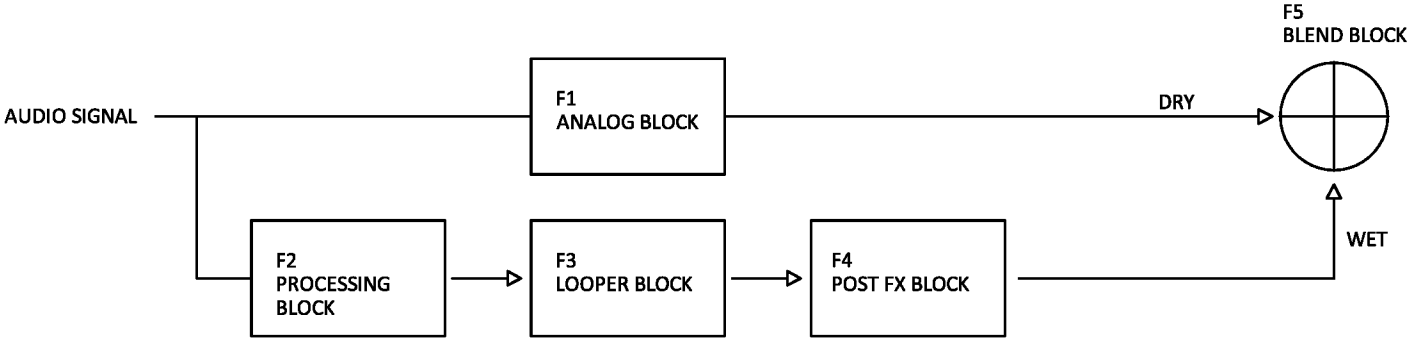
FIG. 5 illustrates the relationship between the DRY and WET signals and outputs 1 and 2, depending on the state of the SPLIT switch.
FIG. 6 shows the device's main block diagram.
Figure 7:
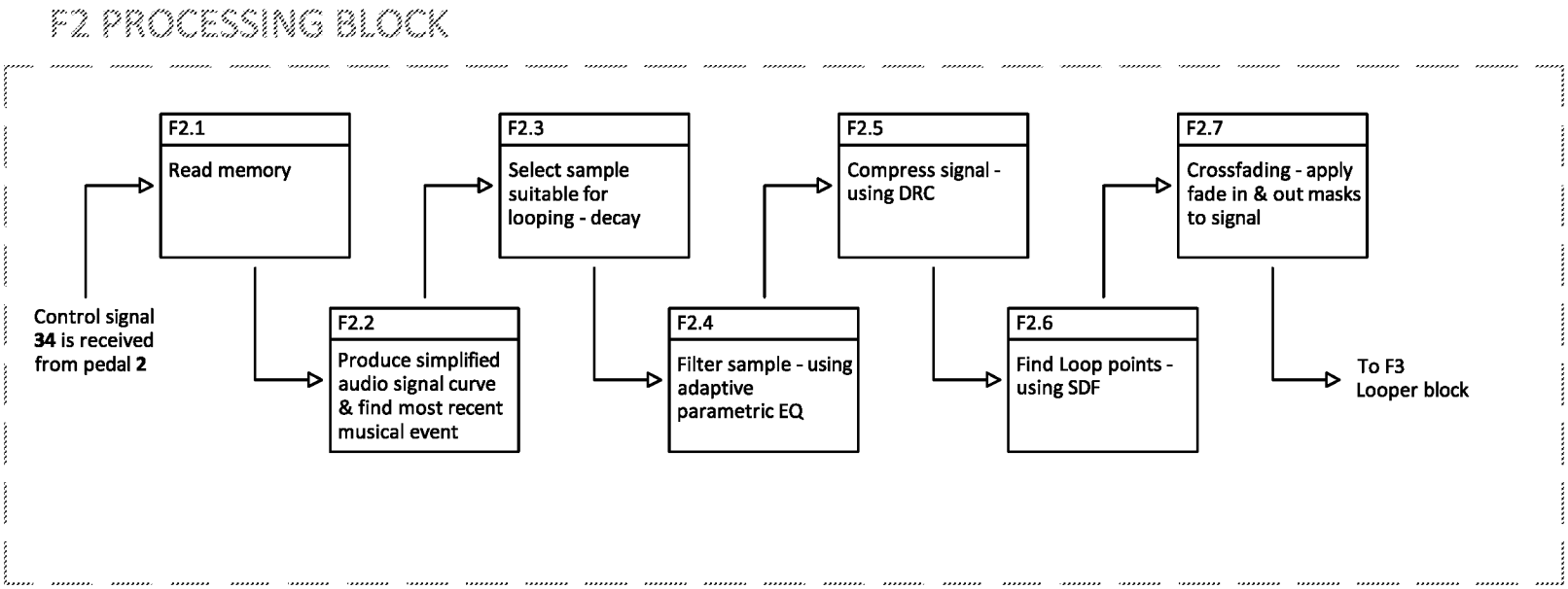
FIG. 7 is a diagram of processing block F2.

Musicians are encouraged to use the device in tandem with other external effects units (pedals, sequencers, etc.). In the preferred embodiment, the device offers two ¼ inch jack outputs 8, 9 (FIG. 1) in order to support a simultaneous connection with two separate effects chains and/or amplification devices. When only one output 8 is used, the wet and dry signals are combined into one channel, but when both jack outputs 8, 9 are used the wet and dry signals may be split. A two-position selection switch 10 (SPLIT) may be installed on the invention's back-panel, allowing the user to control the relationship between the dry and wet signal within both of the device's outputs (FIG. 5).

The device can be powered via a standardized 9V DC power supply input 11—such power sources are the most widely used among musicians. Due to the relatively high power consumption of the proposed device, there will likely be no attempt to include a 9V PP3 battery slot in the device (which is the industry standard for similar effects units). Future versions of the device may offer a separate rechargeable battery pack, designed specifically for this invention.

The device in its current embodiment does not provide a separate ON/OFF switch—the device will switch ON as soon as the appropriate 9V DC power supply is connected to the power supply input 11 and a ¼ jack is plugged into the output 8. The device's ON state may be indicated by an indication LED 14 (FIG. 2) installed underneath the pedal 2 for inputting the control-signal 34. Another indication LED 12 may be positioned on the face of the body 1, programmed in relation with one of the device's parameters, for example—indicating when the maximum setting on the TIME potentiometer 4 has been dialed in, etc.

Signal Path and Main Electronic Blocks

Figure 4:
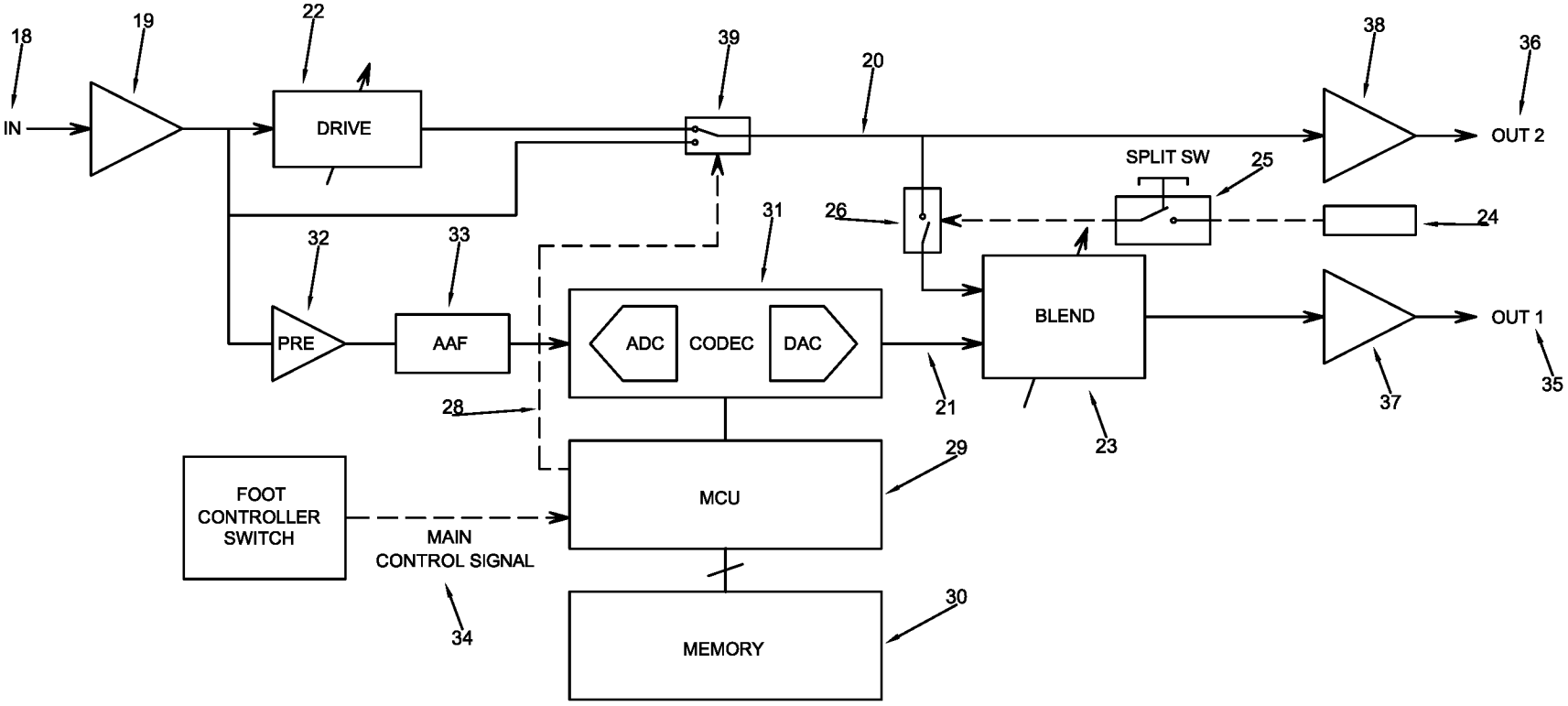
FIG. 4 illustrates a signal path and main electronic blocks.

The main functional electronics blocks, indicated in FIG. 4, are: one audio input 18, one input buffer 19, drive circuit 22, signal mixer circuit 23, one output sensor 24, one SPST electronically controllable analog switch 26, SPST manual switch 27, microcontroller unit (MCU) 29, memory device 30, audio codec 31, pre-amplifier 32, anti-alias filter 33, two outputs 35, 36, two output buffers 37, 38, one SPDT electronically controllable analog switch 39.

The proposed device receives analog signal from audio input 18 which then passes through an audio buffer 19. In the preferred embodiment, the device is capable of receiving analog audio signal from sound-sources and splitting it into two paths—dry and wet 20, 21.

—Dry Signal—

The dry signal may be amplified by a designated DRIVE circuit 22 and sent towards the signal mixer circuit BLEND 23, where it is combined with the wet signal. If both output jacks 8, 9 (FIG. 1) are plugged in, the sensor 24 located on the analog OUT 2 36 sends a control-signal 25 to the analog switch 26 which may interrupt the dry signal's path to OUT 1 35. This allows the user to completely separate the dry and wet signals, which may be desirable when forming two individual signal chains to two different amplification devices and/or effects units. By adjusting the manual switch SPLIT 27 (FIG. 4), (10 in FIG. 1) the user may choose to send the dry signal to both OUT 1 35 and OUT 2 36—the dry/wet signal's relationship within both outputs is indicated fully in FIG. 5.

Further embodiments of the invention may offer a different number of analog outputs and alternative methods of separating or combining the dry and wet signals.

It may be desirable to have a temporary increase of the dry signal's gain and/or volume levels during the time when wet signal is being generated. In the preferred embodiment an analog DRIVE circuit 22 begins affecting the dry signal—sending it into a soft-clipping stage. The currently preferred diode-based DRIVE circuit 22 is only activated by a designated analog switch 39 when a control signal 28 from the MCU 29 is being received—when the foot-pedal 2 (FIG. 1) is pressed. The amount of gain and/or volume increase added to the dry signal may be adjusted by the user via an analog potentiometer 5 (FIG. 1). If no volume or gain increase is desirable then the GAIN potentiometer 5 (FIG. 1) may be set at unity value.

Other analog or digital effects may be added to the dry signal path 20 in future iterations of the invention, such as compression, EQ, and so on.

—Wet Signal—

The wet signal is produced digitally by the MCU 29, out of a small portion of the audio signal recorded in real-time and stored in the device's memory unit 30.

Regarding the wet signal path 21, it is necessary to convert the analog audio signal from an instrument, for example, a guitar's pickup (magnetic, piezo, etc.) or an instrument microphone, into a digital signal. Before being digitized by an ADC-DAC codec 31, the signal passes through an analog buffer 19, pre-amp 32 and an anti-alias filter 33. In the preferred embodiment the analog signal is being digitized by a lossless audio codec 31 at a 64 kHz sample-rate; however other devices with a different sample-rate may be used.

The MCU 29 constantly stores the digitized signal from the audio codec 31 in a memory device 30. In the preferred embodiment, a 64 Megabit RAM is used, configured to continuously rewrite onto itself and to hold the last few seconds of audio, but other types of memory devices may be used in future embodiments. Upon receiving the main control signal 34 (pedal 2 pressed down), the MCU 29 will access the audio signal stored in the memory device 30, analyze it and choose a suitable note-decay portion (hereinafter—audio sample) of the most recent musical event (chord, note, etc.). See SEC 8.3 for a detailed description of how the sample suitable for looping is chosen and prepared for looping. This sample is used to form a continuous loop (looped sample) (block F3), which is then adjusted in block F4 and to produce the wet signal.

The formed digital wet signal is passed from the MCU 29 through a DAC audio codec 31, which converts it back into analog signal and sends it to the mixer circuit (BLEND) 23. Both of the device's outputs 35, 36 are buffered through analog output buffers 37, 38 and the wet signal produced by the device will always be sent to OUT 1 35. The volume balance between the wet and dry signal in OUT 1 35 may be adjusted by the user with the BLEND potentiometer 3 (FIG. 1), connected to the signal mixer circuit 23.

Adaptive Real-Time Audio Sampling and Looping Method

As stated in previous sections, the aim of the proposed device is to give musicians the opportunity of prolonging the decay portion of any complex musical sound, such as a strummed chord, a single note, etc., while preserving most of the natural characteristics of each particular instrument and/or of each particular musical event (attack, volume, vibrato etc.). It is also stated in the summary of this document that the sound synthesis method used in this device, referred to in this document as adaptive real-time audio sampling and looping, is different from oscillator-based synthesizers, because it is not able to generate new musical sounds autonomously, and always requires a previous audio source-signal (musical event) which is used for sampling and synthesizing sound (wet signal). The resulting output is therefore pre-determined in tonality, note composition and timbre by its respective source-sound (musical-event). The following section aims to clarify and illustrate the full process of producing the Sostenuto effect (wet signal).

FIG. 6 diagram should be viewed in relation to FIG. 4, where Analog block F1 relates to the dry signal chain 20 and DRIVE circuit 22 (FIG. 4), and Blocks F2, F3, F4, represent the actions performed by the audio codec 31, MCU 29, and memory device 30, in order to form the wet signal.

Processing Block F2 is where the signal from the memory unit 30 is analyzed, and where a suitable audio sample from the source-event is selected and adjusted (EQ & compression). Looping Block F3 is where a continuous circular playback loop is formed (looped sample). Post FX Block F4 controls the signal's dynamics, decay length, responsiveness, etc., and may add various embellishments (filters, EQ, etc.) to the looped sample—thus producing wet signal.

F2 is the main software Block of the device, and it is where the Adaptive Real-Time sampling and looping of audio signal is performed—the audio processing method which is the key distinguishing factor of the proposed invention.

Block F2.1

Figure 8:
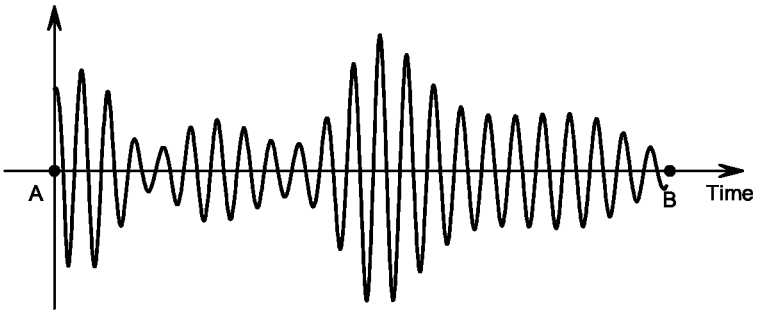
FIG. 8 shows an example of audio data content stored in the memory device (Circular audio buffer), upon receiving the main control signal.

Upon receiving the control signal 34 (FIG. 4) from foot-pedal 2 (FIG. 1), the MCU 29 reads the device's memory unit 30 which is configured to constantly rewrite onto itself forming a Circular Audio Buffer (CAB) FIG. 8. The current Memory device 30 is configured to hold approximately one second of audio with a 64 kHz sample rate, however future iterations may increase the size of the Memory device 30 to accommodate a larger CAB (Circular audio buffer) (FIG. 8).

In order to choose a sample best suitable for synthesizing the wet signal the most recently recorded musical event must be identified from the CAB and it must be analyzed in order to detect the musical event's attack, decay and release portions (see clarification of terms above).

Block F2.2

As soon as the main control signal 34 is received, Block F2.2 proceeds to analyze the audio signal stored in the memory device's 30 CAB at that moment (FIG. 8). The complexity of raw audio data from musical instruments (complex polyphonic sounds, multiple strings, harmonics, resonance, and other factors) may inhibit the process of choosing a sample suitable for looping; therefore, the raw audio data is simplified.

Figure 9:
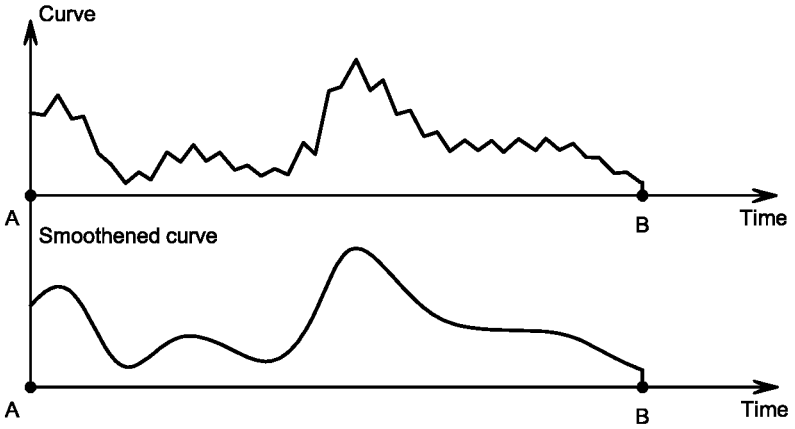
FIG. 9 is a simplified representation of audio signal (variance, spectrum centroid, envelope, etc.) before (top) and after (bottom) smoothening.

Raw audio signal may be simplified in a number of mathematical and statistical methods, thus producing a smooth audio curve representing the signal's dynamic and/or spectral properties as shown in FIG. 9.

One of the methods that may be used by the device is based on calculating the signal's variance over time, and then applying a sliding average function to even out the variance's raw results.

First the signal is split into small segments and Var(X) is calculated in each segment:

$$\mathrm{Var}(X) = \sum_{k=0}^{K} (X[k] - \overline{X})^2;$$

where:

X—signal portion analyzed,

X—segment's mean value,

X[k]—$k^{th}$ point of the segment and

K—length of the segment.

As variance values throughout the whole CAB are obtained, a sliding average function may be used to obtain a smoother, more even audio signal curve:

$$SA(x) = \frac{1}{L}\sum_{k=0}^{L-1} X[x+k];$$

where:

L—length of the sliding average (number of points per calculation—typically 3, 5, 7.)

X—variance function to even out

SA(x)—$x^{th}$ point of Sliding Average result k—summation index

An alternative method of simplifying the audio signal is performing a series of spectral centroid calculations at various points throughout the length of the CAB. The raw signal is split into small segments and FFT analysis is performed for each segment. The FFT values are multiplied by their respective FFT frequency bins k—the sum of these results are used to form a spectral centroid of that particular segment. As centroid values throughout the whole CAB are obtained, a curve representing the audio signal's spectral and dynamic properties over time is formed.

$$\mathrm{Centroid} = \sum_{k=0}^{NFFT} kF[k];$$

where:

F[k]—$k^{th}$ point of FFT result k—FFT frequency bin

NFFT—length of FFT analysis window

Figure 10:
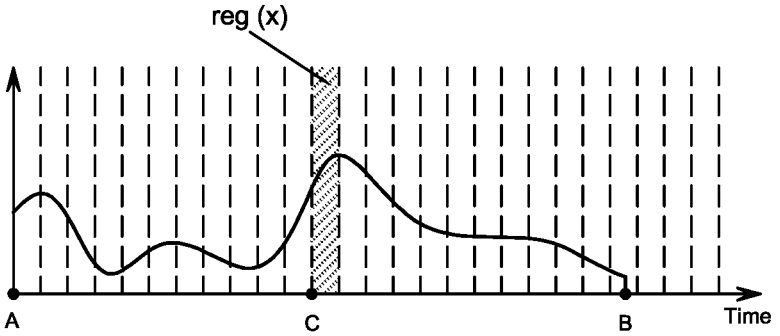
FIG. 10 shows region X—indicating the beginning of the most recent musical event.

The resulting evened out audio signal curve (FIG. 9) can now be analyzed in order to identify the most recent musical event, such as a strummed chord, plucked note, etc. The curve of the signal stored in the CAB is split into many small segments (FIG. 10) and the behavior of the signal curve (whether it is rising or falling) within each segment is analyzed starting from point B FIG. 10, where the control signal 34 is received, and moving towards the beginning of the CAB (point A, FIG. 10).

Figure 11:
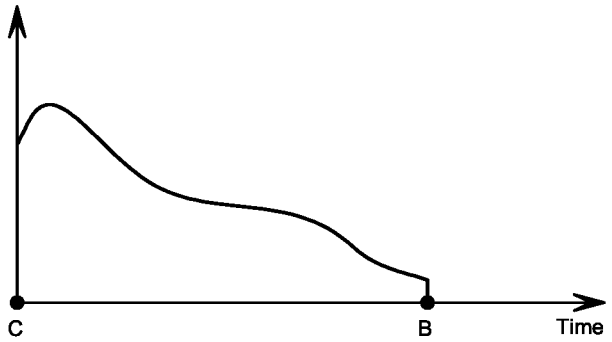
FIG. 11 shows the most recent musical event isolated.

If the main-control signal 34 has been received during the decay portion of a ringing chord/note etc., it is expected that the first series of segments will show a continuous positive tendency when analyzed in the method described above (from point B ( ) towards point A (beginning of CAB)), indicating a gradual dynamic or spectral decay of the signal. As soon as the tendency of the signal curve turns negative, as highlighted in region X, FIG. 10, it is considered that the release part of the previous musical event has been reached—all signal related to the most recent musical event has already been identified (point B till region X, FIG. 10). Point C is established at the beginning of region X (FIG. 10), and all signal prior to point C is discarded (region A-C, FIG. 10), and hereinafter the isolated section from point C to point B (FIG. 11) is considered the most recent musical event.

Block F2.3

As discussed above, it is assumed that each musical event consists of an attack, decay and release part. The most recent musical event (FIG. 11) must now be deconstructed and analyzed, in order to find a smooth portion of audio, suitable for looping—i.e. the musical event's decay period (sample).

Figure 12:
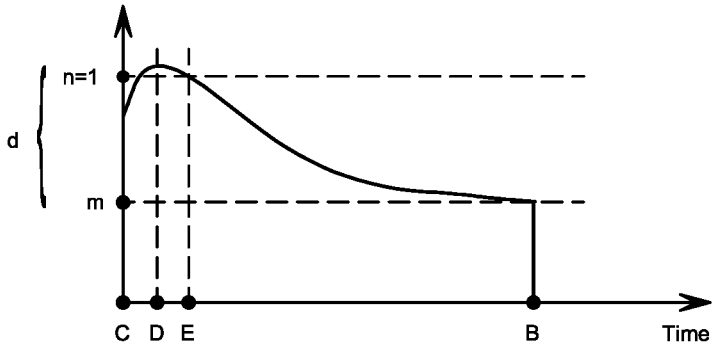
FIG. 12 shows selecting a sample from a low-dynamic musical event (full region EB).
Figure 13:
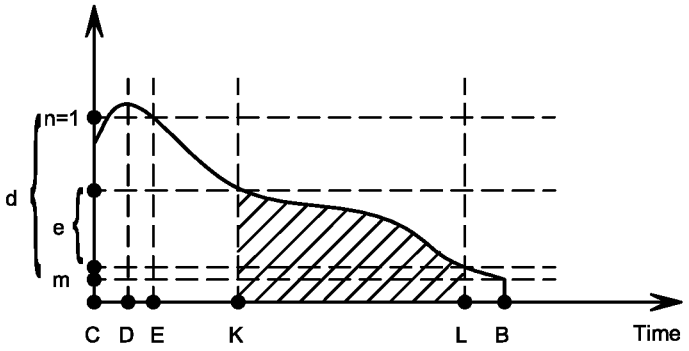
FIG. 13 shows selecting a sample from a high-dynamic musical event (region KL is chosen, based on e).

FIGS. 12 and 13 demonstrate how the particular length of the sample suitable for looping is determined.

Firstly, the audio signal curve's peak value within region C-B is established (point D, FIG. 12) and point E is established slightly after point D based on a set constant (for example, 85% of the length of D-B but not exceeding 0.1 seconds). The region is then normalized based on the curve's value at point E, thus the curve's value (y) at point E (n, FIG. 12) is 1 (n=1 after normalization) and the (y) value at point B (m, FIG. 12) may vary depending on the audio signal received.

The (y) difference between n-m is calculated and region d is established (d=n−m). If d is smaller than a pre-determined constant a then the whole section E-B is selected for further processing (case demonstrated in FIG. 12). The value of constant a may vary in embodiments, but current experience shows that the optimal value of a is between 0.15 and 0.25.

If d is larger than the given constant a (case demonstrated in FIG. 13) then a limiting threshold region e is introduced based on the value of d/2. The software moves the position of region e along the y axis to select the longest possible region within E-B where the signal falls within the limits of region e. In this particular case illustrated in FIG. 13, a region between points K and L has been identified as the longest continuous section with a steady, even signal curve (within the limits of e). Anything outside the region K-L (regions C-K; L-B FIG. 13) is considered an unusable portion of the musical event.

The resulting portion of audio signal, indicated in FIG. 13 (region K-L), is now considered the musical event's decay portion (smooth section of a decaying audio signal) which may be used for forming a continuous loop.

Other methods for separating the note/chord's gradual decay periods may be used in further embodiments of the invention. For example, a musical event's attack portion may be determined based on certain spectral changes, characteristic to the attack period of a note/chord, such as a rapid increase and decrease (peak) in higher frequency bands (typically above 2 Khz).

When the musical event's (chord/note) decay period is established, (usually with a length between 0.1 and 1 seconds) (K-L, FIG. 14) the processor will create a new audio portion from region K-L, hereinafter referred to as sample, shown in FIG. 14.

The proposed device's ability to autonomously detect a musical event's decay period—sample (with a unique-length each time (between 0.1-1 sec), depending on the particular musical event) is its main distinguishing feature from looper and delay devices described in the summary of this document, where a time-interval for looping or performing repeated playback must be pre-selected manually.

All processes described further in this document, including the filtration, compression, cross-fading, looping and playback of the sample can be performed within the MCU 29, while all new incoming audio signal is being constantly stored on the external memory 30 and readily accessible for processing at any time.

This ensures that the pedal 2 for inputting the main control signal 34 may be pressed rapidly, and a new sample may be selected and instantly formed into wet signal at any time, even while the previous wet signal is still fading out (TAIL).

Block F2.4

Figure 14:
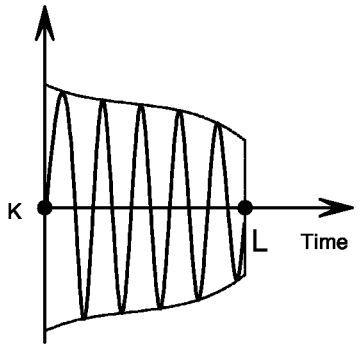
FIG. 14 illustrates how short section of audio (sample), suitable for looping is determined.
Figure 15:
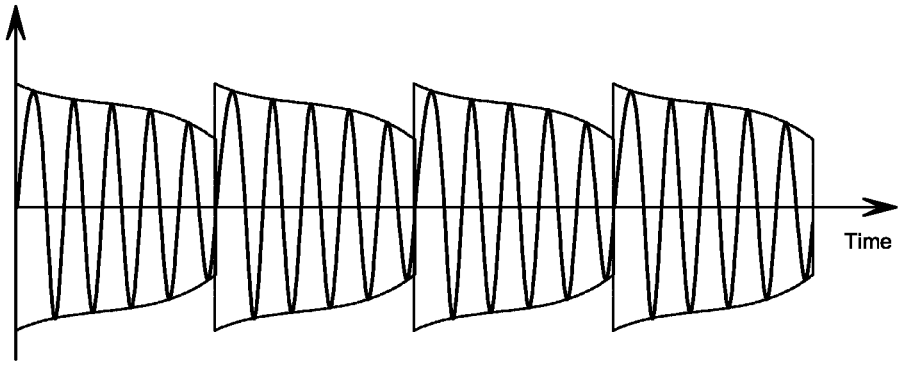
FIG. 15 illustrates continuous circular playback of sample without any adjustments.

Even though the chosen sample—shown in FIG. 14—is already the isolated decay part of the given musical event—if it were played back to back in a continuous cycle (looped), for example, the way a basic looper unit does (or a delay unit under certain settings), the resulting wet signal would sound staggered and unnatural, due to mismatches in dynamics and timbre in the sample's start and end regions (FIG. 15).

This is because any audio sample produced from analog instruments is likely to fluctuate and change over time—most notably there is an overall change in volume (amplitude) within each the sample, due to the natural gradual decay of musical sounds such as the case with plucked strings, bells, percussion etc., or other dynamics irregularities that may occur when playing wind and bowed instruments.

Figure 17:
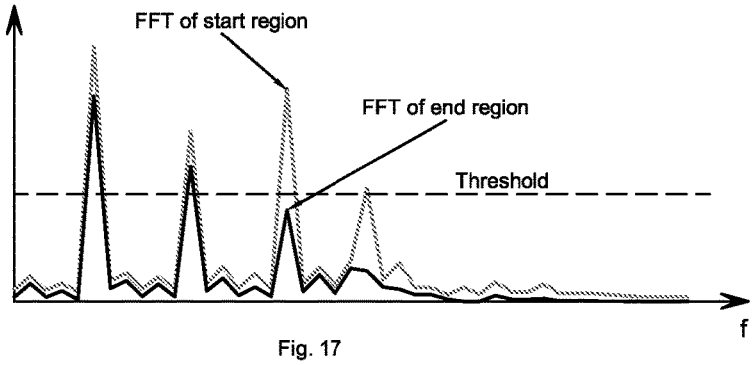
FIG. 17 shows results of FFT analysis at the sample's start and end regions; threshold of the peak-detection algorithm.

Also, in the case of every individual musical event (depending on its tonality, the instrument's timbre, attack, etc.), different harmonic components will decay at different rates over time—typically higher frequencies will decay more rapidly than lower frequencies (FIG. 17).

Figure 16:
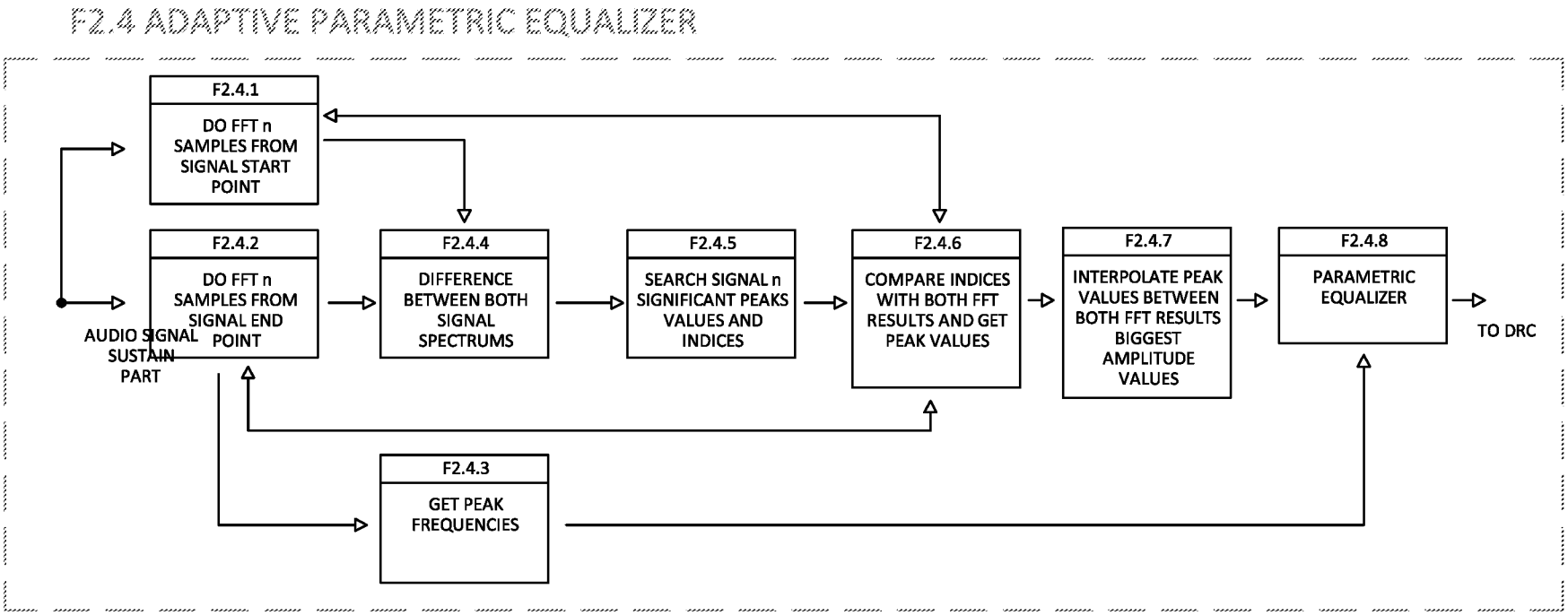
FIG. 16 is a block diagram of F2.4—adaptive parametric EQ.

Block F2.4 (FIG. 16) employs a method named Adaptive Parametric Equalization to even out these harmonic fluctuations throughout the length of the whole sample.

Blocks F2.4.1-F2.4.7 (FIG. 16):

Before looping the sample FFT analysis at the sample's start region is performed, and its most significant frequency bands are identified, based on a threshold set by a conventional peak-detection algorithm. As a result—a certain number of frequency bands are identified as the signal's extremes (FIG. 17), and these are considered the sample's main harmonics. The same frequency bands are then measured using FFT at the sample's end region, thus indicating the change occurring in the sample's most significant frequency bands over time. The device in its preferred embodiment typically identifies a pre-set number (p) of the most dominant frequency bands, but any number of frequency bands may be used, also depending on the nature of the sample, or how the threshold is set—in FIG. 17 these are shown as four (p=4) main spectrum peaks.

Block F2.4.8 uses the spectral information gathered during FFT analysis in the previous Blocks (F2.4.3-F2.4.7) to generate the parameters for a time-varying parametric EQ, in order to compensate for the changes in the sample's most significant harmonics (FIG. 17).

Figure 18:
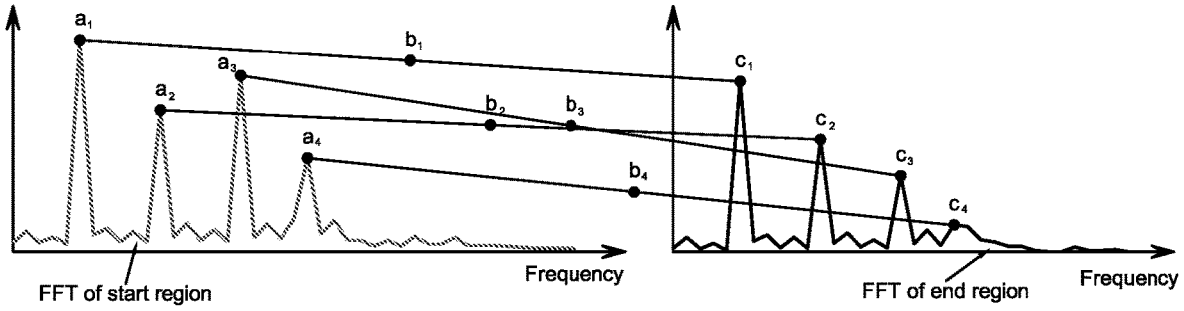
FIG. 18 illustrates interpolating the values of spectrum peaks between the sample's start and end regions.
Figure 20:
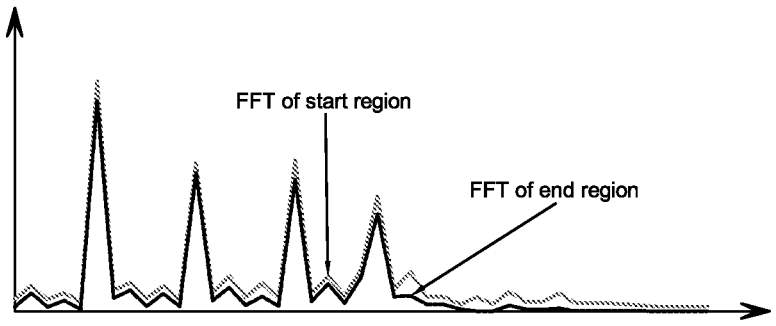
FIG. 20 shows results of FFT analysis at the sample's start and end regions after adaptive parametric EQ.

The aim is to preserve these frequency bands throughout the sample at the same level as in the start region (FIG. 20). FFT results from the sample's start-region (points a1-a4, FIG. 18) and end region (points c1-c4, FIG. 18), can be interpolated to predict new values of said spectrum peaks at intermediary points. Only one such set of points is illustrated in FIG. 18 (b1-b4), but the number of intermediary points resulting from interpolation may be increased according to preference.

Figure 19:
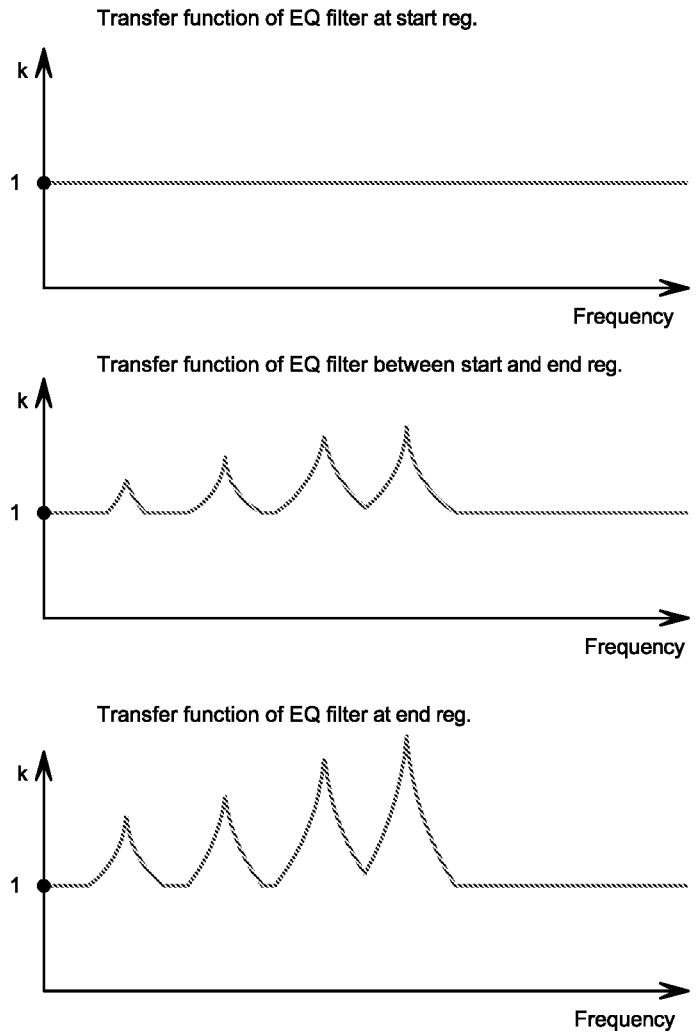
FIG. 19 illustrates three filter transfer functions designed to compensate the change in harmonic content within the sample.

Based on the spectrum peak values at points a1-a4, b1-b4 and c1-c4—a corresponding time-varying band-pass filter EQ may be generated and gradually applied to the sample. The sample is filtered gradually in small segments, with a different set of EQ parameters for each segment. FIG. 19 shows three filter transfer functions based on the measurements indicated in FIG. 18, however—as stated above—the number of intermediary points may be increased.

As a result—when playing the selected sample in a looped cycle the audible difference between the sample's start and end points becomes less obvious, meanwhile preserving the instrument's or particular musical event's distinguishing spectral properties (FIG. 20).

Further embodiments of the invention may use more complex methods for equalizing spectral content of a given sample, for example, perform FFT analysis for each segment and generating a more detailed set of parameters without the use of interpolation. Another embodiment may apply a set of Goertzel filters using the frequencies detected during FFT analysis of the sample's start region in order to measure changes of the most significant harmonic components throughout the sample for each segment.

Figure 21:
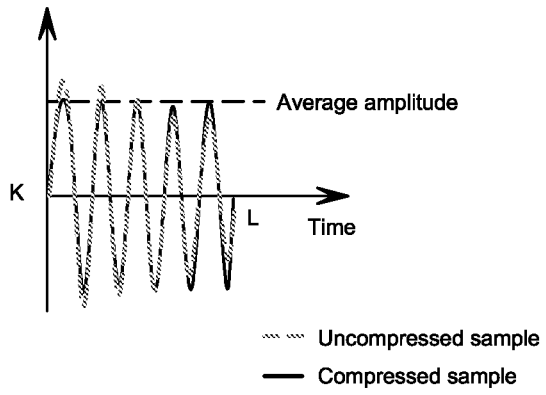
FIG. 21 shows sample before and after compression.

In block F2.5 the sample's overall volume change (caused by natural note-decay or other factors) is evened-out, by using dynamic range compression (FIG. 21). Depending on each particular sample, the required amount of compression will differ; therefore the compressor's threshold level will be set based on the sample's average amplitude.

The particular type of compression, as well as its variable parameters (knee, ratio, attack speed etc.) may be adjusted differently in various embodiments of the device, but fundamentally—the use of a compressor (dynamic range limiter) is instrumental for synthesizing a continuous, even musical sound from portions of audio signal, recorded in real-time and stored on the device's Memory unit 30.

The current order of events (adaptive EQ⇒compression⇒) may be altered, interchanged or supplemented with additional steps in order to achieve the desirable effect. Other embodiments/methods may combine the equalization and compression blocks in a single process, based on either a specifically designed multiband compression system or, alternatively, use a more detailed equalization system.

Figure 22:
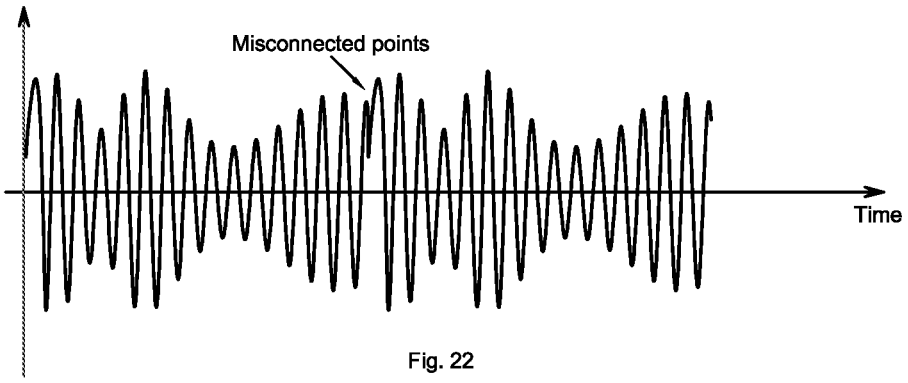
FIG. 22 shows misconnected points when looping.

Even after the previous steps (EQ (F2.4) and compression (F2.5)) any complex/polyphonic audio sample, when played in a circular way may still produce audible clicks or noises at its connection points if no cross-fading region is established (FIG. 22—showing misconnected points).

Figure 23:
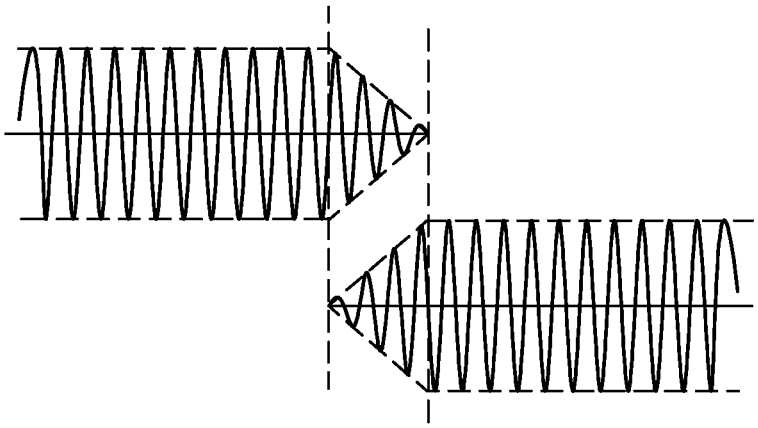
FIG. 23 illustrates cross-fading.

In block F2.6 the sample's precise positions for cross-fading (FIG. 23) are determined, where the optimal overlap region is selected in such a way as to eliminate any noise, audible interference or phase mismatch during cross-fading.

Figure 24:
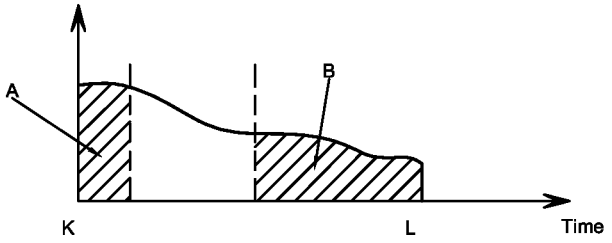
FIG. 24 shows two regions (A & B), at the sample's start and end points.
Figure 25:
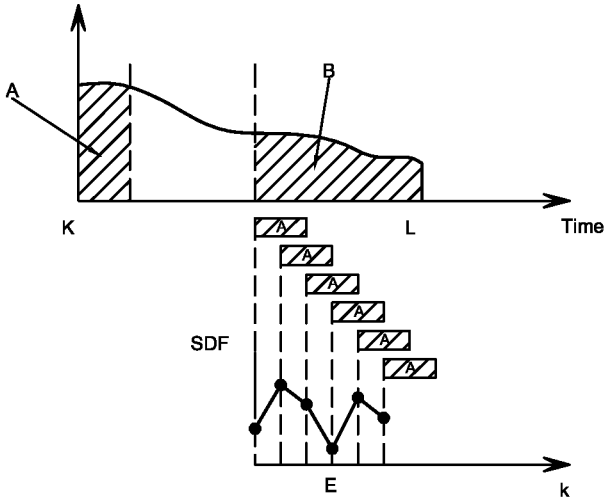
FIG. 25 illustrates region A positioned on multiple points within region B; corresponding SDF values plotted.

FIG. 24 illustrates two regions (A, B) selected at the start and end of the sample; their size being defined as a certain percentage of the overall sample, which may vary in different embodiments. The value axis (y) on FIG. 24 and FIG. 25 shows the amplitude of the sample selected previously in F2.3. The objective is to find a portion of the signal within region B (the end portion of the sample), which is most similar to region A (the sample's start-portion)—this information will be used later for choosing an optimal overlapping position for cross fading.

To find the best overlapping positions the information within regions A and B is down-sampled in order to decrease the computation time, and similarities within both regions are compared by using a Squared Difference Function (SDF).

$$SDF[k] = \sum_{n=0}^{N} (A[n] - B[n+k])^2,$$

where:

SDF[k]—squared difference function

N—length of region A k—index of SDF function [0 . . . length of SDF result].

n—index of regions A and B [0 . . . N]

A[ ]—region A

B[ ]—region B

Additional conditions:

$$n+k \leq \text{length}(B).$$

As shown in (FIG. 25) Region A is positioned on a multitude of positions inside region B and the Squared Difference between both overlapping regions is calculated in each location (number of positions is based on the resolution of the down-sampled signal). The position with the lowest value of SDF is considered the most desirable looping point for cross-fading regions A and B (E, FIG. 25), where phase mismatch and other undesirable effects would be reduced to a minimum.

Other methods, such as cross-correlation, may be used to determine matching regions suitable for overlapping.

Figure 26:
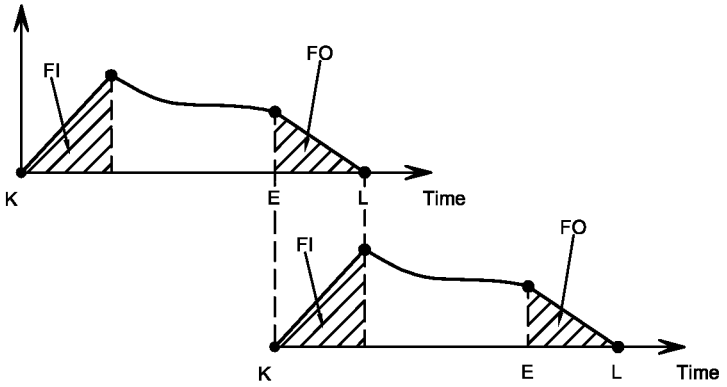
FIG. 26 illustrates Fade-in and Fade-out regions of the sample aligned

Block F2.7 creates a cross-fade between the overlapping regions in order to avoid a volume increase due to the summing of two signal parts FI and FO where the length of FI is the difference between L and E (FI=FO=L−E) (FIG. 26). The use of cross-fading is a standard practice in audio engineering and editing, therefore approaches may vary—but ultimately the goal of cross-fading is to reduce any remaining audible connection and/or transitional sounds to a minimum, resulting in a maximally transition between sounds when looping the overlapped sample.

Figure 27:
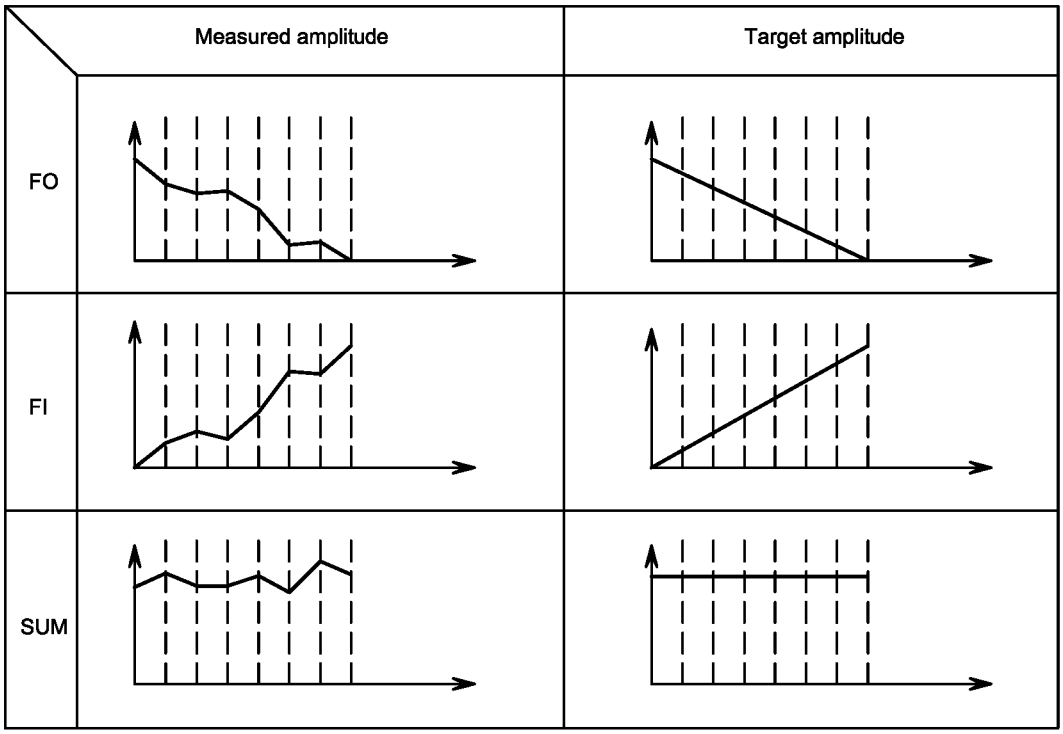
FIG. 27 illustrates the dynamic cross-fading algorithm—regions FI and FO divided into subsections, and compared target amplitude.

Different types of cross-fading may be used; FIG. 27 illustrates the dynamic cross-fading algorithm used by the current preferred embodiment of the device. The cross-fading parameters are determined by dividing regions FI and FO into smaller sub-sections, and based on the measurements of signal power or amplitude within those subsections, adding FI and FO in such a way that the sum of both signals remains at a target value (signal amplitude at point E).

Figure 28:
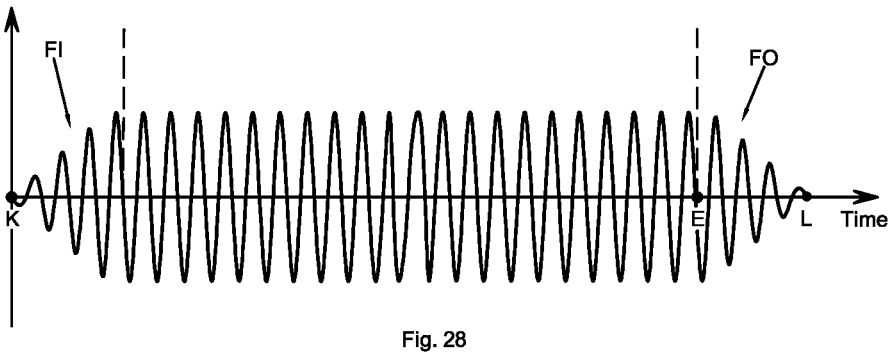
FIG. 28 is a sample shown as audio waveform, adjusted for circular playback.

The volume fade-out and fade-in is then applied permanently to the audio sample in regions FI and FO according to the cross-fading parameters determined in the previous block F2.7 thus forming the adjusted sample (FIG. 28).

Adjusted sample—an audio sample chosen from the most recent musical event, adjusted by the Adaptive Parametric EQ, dynamic range compressor and with volume decreases at cross-fading regions FI and FO.

Looping the Adjusted Sample and Producing the Final WET Signal

Figure 29:
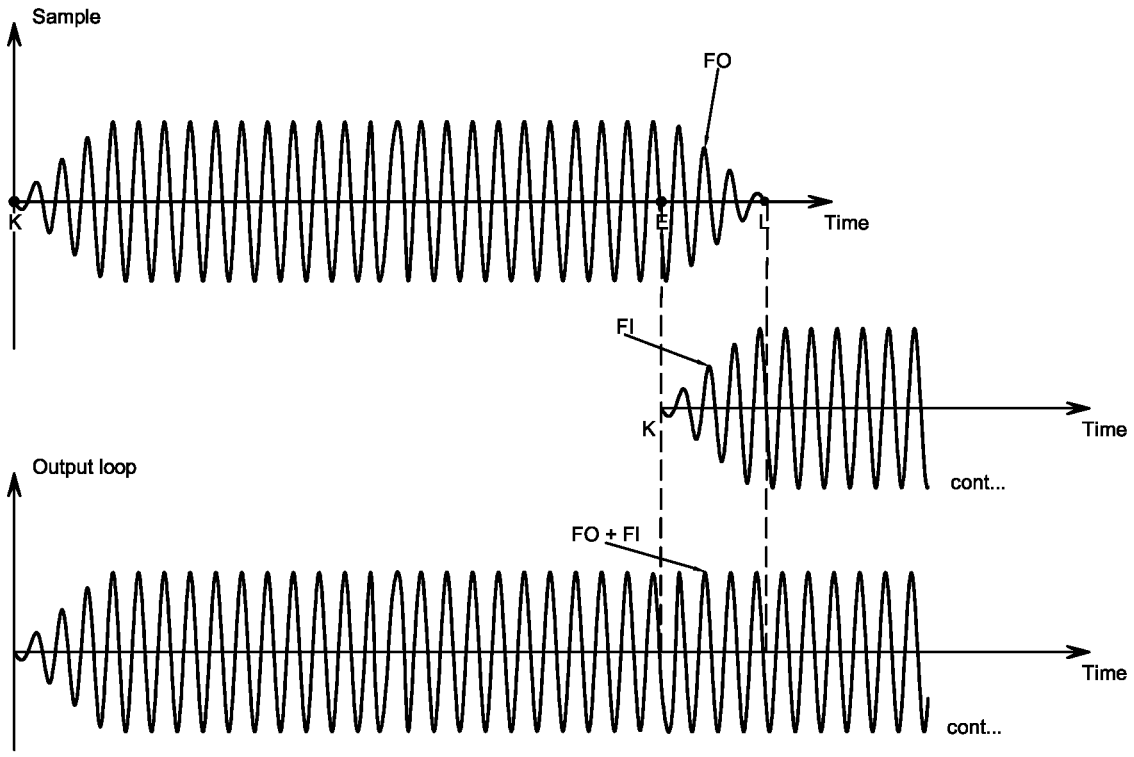
FIG. 29 shows circular playback demonstrated with resulting output—continuous loop.

The adjusted sample may now be sent to block F3, where it is played back circularly, as shown in FIG. 29—as soon as the adjusted sample's end region (point E in FIG. 29), is reached a new playback read begins from the adjusted sample's start region (point K), forming an overlap and summing the start and end regions FI and FO of the sample.

The resulting output signal from block F3 is a maximally even continuous musical signal generated from a complex audio sample which, in the opinion of the inventors and many musicians, is a more realistic synthesized signal than those synthesized by envelope/oscillator-based units etc.

Figure 30:
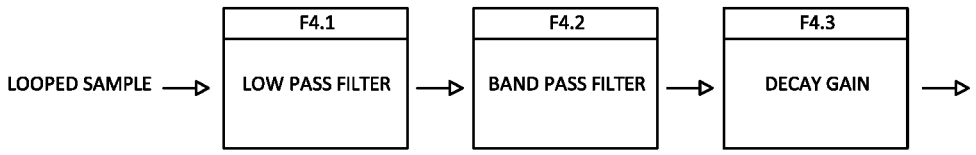
FIG. 30 is a F4—Post-FX Block diagram.

The continuously looped sample (as shown in FIG. 29) is now sent to POST FX Block F4 (FIG. 30), where it may undergo certain adjustments, to make the resulting wet signal sound more similar to how musical instruments behave in nature. Firstly, the gradual change of certain frequencies may be reinstituted into the continuous loop, using time-varying low-pass and band-pass filters (F4.1, F4.2), and also, depending on the TIME potentiometer's setting, the overall gain decay of the wet signal may be applied in F4.3.

Figure 31:
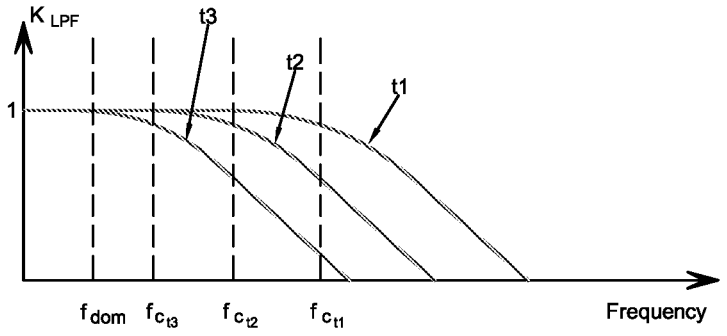
FIG. 31 illustrates a transfer function of low-pass filter over time.
Figure 32:
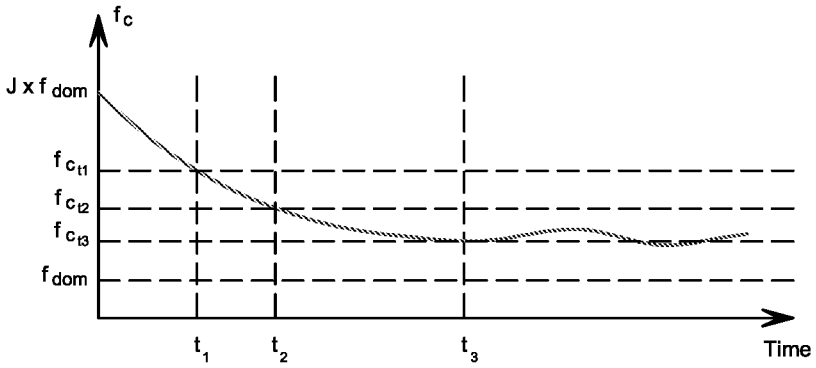
FIG. 32 shows a low-pass filter's cutoff frequency (f_c) over time.

FIG. 31 illustrates how the transfer function $K_{LPF}$ of the time-varying low-pass filter F4.1 changes over time. The low-pass filter's cut-off frequency $f_c$ varies in time as shown in FIG. 32, where three separate points in time ($t_1$, $t_2$, $t_3$) show the corresponding $f_c$ values ($f_{ct1}$, $f_{ct2}$, $f_{ct3}$). The value of the dominant frequency $f_{dom}$ shown in both figures may be determined based on the results of the FFT analysis of the given musical event performed earlier in F2.4.1. $f_{dom}$ may also be multiplied by a constant J (FIG. 32) to establish the initial value of the filter's cut-off frequency. As the filter's cut-off frequency decays, it gradually approaches the $f_{dom}$ frequency band, without ever crossing it—as shown in FIG. 32. After point $t_3$ the low-pass filter's cut-off frequency $f_c$ remains roughly static in slight oscillation.

Figure 33:
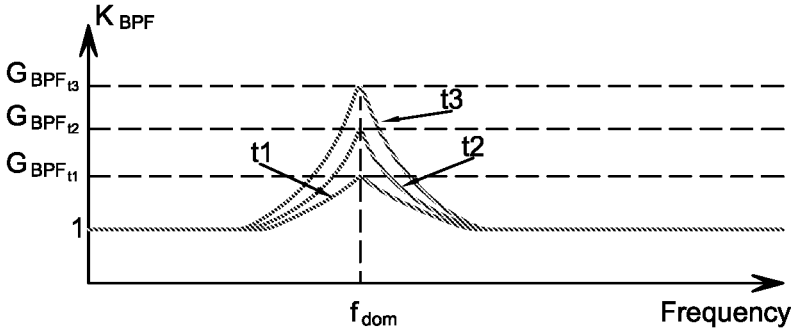
FIG. 33 shows a band-pass filter's cutoff frequency (f_c) over time.
Figure 34:
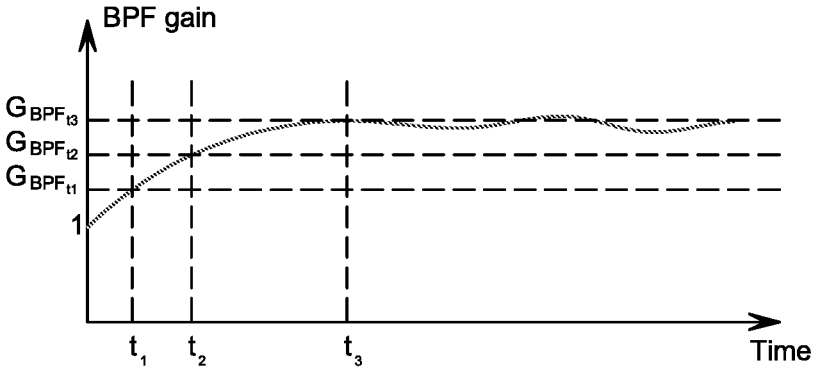
FIG. 34 shows a change of the Band-pass filter's gain over time.

The band-pass filter F.4.2 is used to apply a gradual boost to the looped sample's dominant frequency band. The change in time of the transfer function $K_{BPF}$ is shown in FIG. 33, where values $G_{BPFt1}$, $G_{BPFt2}$, $G_{BPFt3}$ at given points in time ($t_1$, $t_2$, $t_3$) indicate the gradual increase in gain for the dominant frequency band (center frequency is $f_{dom}$. The resulting tendency of $G_{BPF}$ (FIG. 34) shows a gradual rise, followed by a slightly oscillating static pattern from point $t_3$ onwards (similar to those shown in FIG. 32).

Figure 35:
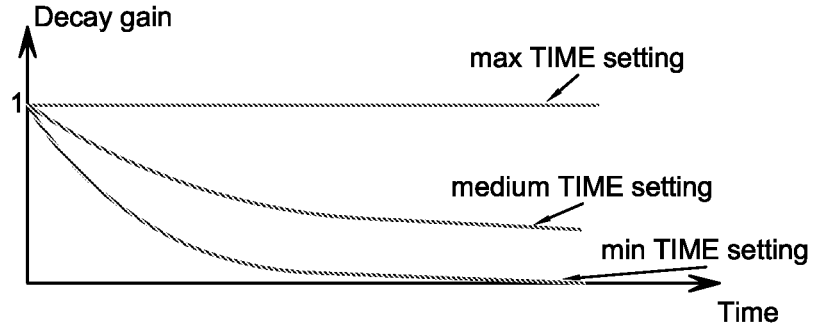
FIG. 35 shows a Decay Gain-value over time, in relation with the TIME potentiometer's setting.

Additionally in the preferred embodiment, the user may manually control the signal's overall decay length by adjusting the TIME potentiometer 4 (FIG. 1) from a very short setting ("realistic") (such as 5 seconds long)—to an infinite decay. FIG. 35 illustrates the pattern for the looped sample's overall gain decay over time, depending on the TIME potentiometer's 4 setting.

A specific LED 12 may be installed, indicating when the device is in the INFINITE decay mode (max TIME setting in FIG. 35)—TIME potentiometer 4 is in the maximum setting.

The resulting signal, consisting of a sample (determined and adjusted in Block F2) looped circularly (in block F3) adjusted by a time-varying low-pass filter and gradual volume decrease (Post FX Block F4) is considered the completed wet signal.

The wet signal can also be faded out of the mix rapidly by releasing the foot-pedal 2 (control signal is interrupted). The exact speed of the fade-out region (Tail reg. in FIG. 36) may be set proportionally to the settings of TIME potentiometer 4, and further adjusted by using the internal TAIL potentiometer 16.

The preferred embodiment is designed and adjusted for achieving a controllable wet signal which is maximally realistic to the natural decay-sound of any source instrument or musical event.

However, it may be desirable for some users to produce a distorted, unrealistic "choppy" wet signal where the samples are looped inaccurately. A dedicated GLITCH potentiometer 6 (FIG. 1) increases the value of the limiting threshold in BLOCK F2.2 and F2.3, above the optimal setting. As a result the separation of attack and decay within sound-events is performed inaccurately, thus producing an odd effect. Different ways of distorting/disrupting the wet signal may be offered in future iterations of the proposed invention.

In further embodiments, other effects may be added in the POST-FX block F4, in order to alter the properties of the wet signal, including classic digital effects, such as delay, reverb, tremolo, chorus, dynamic compression etc.

After the finished wet signal has been produced and all desired effects have been added to it, it is sent to the DAC (digital-analog converter) 31, then to F5 BLEND BLOCK (see 23, FIG. 4; F5, FIG. 6), and finally to analog output buffer 37.

The produced wet analog signal can be routed to one or multiple outputs. In the preferred embodiment, the invention offers a two-¼ jack output system 35, 36 with three possible output configurations, controlled by a two-position switch 10 labeled SPLIT (FIG. 1).

As mentioned before, the wet signal and the dry signal may be mixed together and sent to one output 35. The mixing ratio between the wet and dry signals is adjustable by an analog potentiometer labeled BLEND 3 (FIG. 1).

By adjusting the TIME potentiometer 4, the user may control the length and behavior of the wet signal over time, according to needs; FIG. 35 illustrates the principle of how the wet signal may behave over time according to different TIME potentiometer 4 settings.

Figure 36:
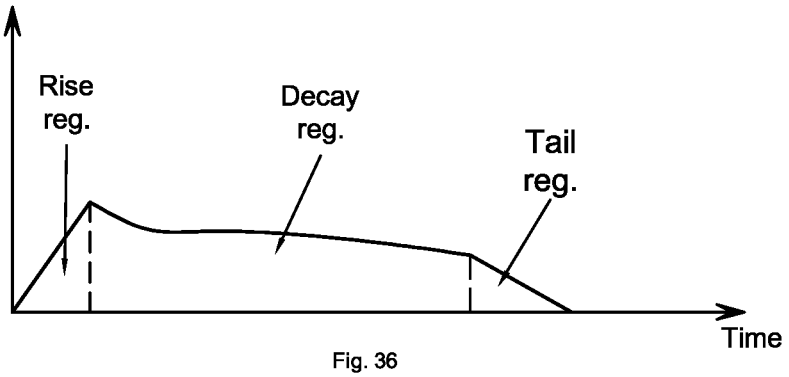
FIG. 36 illustrates a looped signal's rise, decay, tail regions.

The method and device proposed is designed to produce the claimed Sostenuto wet signal and send it to the analog outputs with a minimal, humanly-inaudible time delay between pressing the pedal 2 and receiving the wet signal in the devices output/s. In practice, however, it may be desirable to have the wet signal gradually fade-in as indicated in FIG. 36 (Rise reg.). The precise speed of the fade-in (Rise reg.) may be adjusted with the RISE internal potentiometer 15.

As mentioned in the summary of this document—the method and device proposed is not able to generate new tonal content autonomously, and always requires a previous source-audio signal (most recent musical event) for sampling and synthesizing the wet signal. Therefore the success of the method depends on the precise input of the Main Control signal 34, which has to always follow the musical event.

In case if a faulty main control signal 34 is received (before or during the attack period of a musical event) and no clear sample may be selected, a basic reverb or delay setting may be applied to the audio signal to produce a substitute for the expected wet signal.

The current device's preferred method of inputting the main control signal 34 (manual—via pressing the foot-pedal 2) may be altered. It must be noted that other types of switches, buttons or external controllers may also be used for inputting the main control signal 34. Future versions of the device may also be able to generate the main control signal 34 automatically based on audio signal analysis, thus avoiding the need for any switches, buttons, pedals, etc., or any other means for inputting the main control signal 34. For example, the main control signal 34 may be generated automatically, as soon as the release part of a musical event is detected, thus beginning the formation of the wet signal immediately after the release of a note/chord.

One practical application of such a method is the possibility of synthesizing wet signal from multiple musical events simultaneously, for example—during the time when the device is engaged, each new detected musical event may trigger its own main control signal 34, as described above, be looped and sent to the BLEND circuit 23. Such an approach would allow the musician to play a succession of notes/chords (musical events) and have each one of them ring out (simultaneous looped playback) for as long as necessary—based, for example on the TIME potentiometer's 4 setting.

REFERENCE NUMBERS

| | |
|---|---|
| 1 | body |
| 2 | pedal |
| 3 | BLEND potentiometer |
| 4 | TIME potentiometer |
| 5 | GAIN potentiometer |
| 6 | GLITCH potentiometer |
| 7 | jack input |
| 8 | jack output 1 |
| 9 | jack output 2 |
| 10 | SPLIT switch |
| 11 | DC power supply input |
| 12 | LED for indication |
| 13 | two-positional switch |
| 14 | power LED |
| 15 | RISE internal potentiometer |
| 16 | TAIL internal potentiometer |
| 17 | protective rubber cover |
| 18 | audio input |
| 19 | input buffer |
| 20 | DRY signal path |
| 21 | WET signal path |
| 22 | DRIVE circuit |
| 23 | BLEND circuit |
| 24 | sensor for output 2 |
| 25 | control signal (output 2) |
| 26 | analog switch |
| 27 | split switch |
| 28 | DRIVE control signal |
| 29 | MCU |
| 30 | memory unit |
| 31 | DAC-ADC codec |
| 32 | pre-amp |
| 33 | anti-alias filter |
| 34 | main control signal |
| 35 | output 1 |
| 36 | output 2 |
| 37 | output buffer (out 1) |
| 38 | output buffer (out 2) |
| 39 | DRIVE circuit switch |

The invention claimed is:

1. An effects device for a musical instrument, comprising:
an input for receiving a signal from a musical instrument;
a control input for receiving a control signal;
an output for connecting the device to a sound reproduction device;
a memory configured to record the input signal; and
a processor configured, upon receiving the control signal, to select a section of the recorded input signal from the memory based on an analysis performed by the processor and to loop the selected section,
wherein the processor is configured to overlap a start region and an end region of the selected section when looping.

2. The device according to claim 1, wherein the processor is further configured to choose the overlapping start and end regions based on the regions' similarity.

3. The device according to claim 2, wherein the regions similarity is determined by calculating correlation between the regions.

4. The device according to claim 1, wherein the processor is configured to cross-fade the overlapping start and end regions of the selected section when looping.

5. The device according to claim 1, wherein the processor is further configured to choose from the memory the section containing the longest possible portion of the recorded input signal suitable for looping.

6. The device according to claim 5, wherein the processor is configured to determine and select the longest signal portion where variance of signal is the steadiest.

7. The device according to claim 1, wherein the processor is configured to filter the selected section of the recorded input signal.

8. The device according to claim 7, wherein the filtering of the selected section is done by applying an adaptive parametric equalizer which normalizes the harmonic content between loop end-points so that the produced sound is even.

9. The device according to claim 1, wherein the processor is configured to dynamically compress the selected section so that the whole section sounds even.

10. The device according to claim 1, wherein the device has an additional control input that allows modifying the decay length of the looped signal.

11. The device according to claim 1 wherein the processor is configured to filter the looped signal so that higher harmonics decay faster than lower harmonics while the most significant harmonic is gradually enhanced to resemble a particular guitar's signal.

12. A method for producing an effect for a musical instrument, comprising the steps:
a) recording an input signal from a musical instrument into memory;
b) analyzing the recorded input signal by a processor; and
c) selecting, by the processor, a section of the recorded input signal and looping it, wherein a start region and an end region of the selected section are overlapping when looping.

13. The method according to claim 12, wherein the selected section contains the longest possible portion of the input signal showing the steadiest signal variance.

14. The method according to claim 12 wherein the overlapping start and end regions are selected based on the regions' similarity.

15. The method according to claim 12, wherein the overlapping start and end regions of the selected section are cross-faded.

16. The method according to claim 12, wherein the selected section is filtering by applying an adaptive parametric equalizer that normalizes the harmonic content of the signal thus ensuring an even sound for the whole section.

17. The method according to claim 12, wherein the selected section is dynamically compressed to ensure that the total section sounds even.

18. The method according to claim 12, further comprising the step of modifying the length of decay of the looped playback.

19. The method according to claim 12, further comprising the step of filtering the looped playback so that higher harmonics decays faster than lower harmonics thus the most significant harmonic is gradually enhanced to resample a typical guitar signal.

* * * * *